United States Patent [19]

Halcomb et al.

[11] Patent Number: 4,963,203

[45] Date of Patent: Oct. 16, 1990

[54] HIGH- AND LOW-TEMPERATURE-STABLE THERMITE COMPOSITION FOR PRODUCING HIGH-PRESSURE, HIGH-VELOCITY GASES

[75] Inventors: Danny L. Halcomb, Camden; Jonathan H. Mohler, Spring Valley, both of Ohio

[73] Assignee: The United States of America as represented by the United States Department of Energy, Washington, D.C.

[21] Appl. No.: 500,829

[22] Filed: Mar. 29, 1990

[51] Int. Cl.[5] ..... C06G 33/00

[52] U.S. Cl. ..... 149/37; 149/108.2; 149/109.2

[58] Field of Search ..... 149/37, 108.2, 109.2

[56] References Cited

U.S. PATENT DOCUMENTS

| | | | |
|---|---|---|---|
| 4,104,093 | 8/1978 | Yamaji | 149/37 |
| 4,141,769 | 2/1979 | Akiyama | 149/37 |
| 4,692,259 | 9/1987 | Roman | 149/37 |

*Primary Examiner*—Stephen J. Lechert, Jr.

*Attorney, Agent, or Firm*—Armand McMillan; James H. Chafin; William R. Moser

[57] ABSTRACT

A high- and low-temperature-stable thermite composition for producing high-pressure and high-velocity gases comprises an oxidizable metal, an oxidizing reagent, and a high-temperature-stable gas-producing additive selected from the group consisting of metal carbides and metal nitrides.

16 Claims, No Drawings

HIGH- AND LOW-TEMPERATURE-STABLE THERMITE COMPOSITION FOR PRODUCING HIGH-PRESSURE, HIGH-VELOCITY GASES

FIELD AND HISTORICAL BACKGROUND OF THE INVENTION

The present invention is directed to thermite compositions, and more particularly to a high- and low-temperature-stable thermite composition for producing high-pressure, high-velocity gases. The Government has rights in this invention pursuant to Contract No. DE-AC04-76DP00053 between the U.S. Department of Energy and Monsanto Research Corporation.

Thermite compositions generally consist of a mixture of a finely divided oxidizable metal and an oxidizing agent therefor. The oxidizing agent typically consists of iron oxide. A highly exothermic reaction takes place when a thermite composition is ignited with the resulting oxidation of the metal and reduction of the iron oxide thereby forming molten iron. Preferably, the oxidizable metal is aluminum, and a wide variety of thermite compositions are known which, in addition to aluminum and iron oxide, contain other modifying agents.

Normally, thermite compositions burn with production of little or no permanent gas. The main use of a thermite composition, therefore, is in the production of extreme heat or molten metal, as previously noted. However, when confined, thermite compositions can produce considerable pressure as a result of momentary vaporization of high-temperature reaction products and expansion of impurities and gases in void spaces. It is therefore desirable in certain applications to enhance the gas production by igniting thermite compositions. Conventionally, this is achieved by adding an easily decomposable material, such as Teflon, that would produce gas upon decomposition and/or reaction. However, these materials often adversely affect the properties of the composition, making it less stable even at relatively low storage temperatures.

Accordingly, there is a need in the art for a thermite composition which is stable at relatively low as well as high temperatures, and which produces high-pressure and high-velocity gases upon ignition.

OBJECTS AND SUMMARY OF THE INVENTION

The principal object of the present invention is to provide a high- and low-temperature-stable thermite composition for producing high-pressure and high-velocity gases.

Another object of the present invention is to provide a thermite composition which is stable at relatively low storage temperatures.

Still another object of the present invention is to provide a thermite composition which is stable at relatively high temperatures.

Still yet another object of the present invention is to provide a high- and low-temperature-stable thermite composition which is resistant to accidental ignition.

An additional object of the present invention is to provide a high- and low-temperature-stable thermite composition which makes it possible to do the work normally done with less stable and less safe pyrotechnics.

Still an additional object of the present invention is to provide a high- and low-temperature-stable thermite composition which can safely be used in thermomechanical devices, such as in expanding seals, valves and release or capture mechanisms, and for enhancing cutting action of torches. In addition, the composition of the present invention could also be used in a broad range of environmental conditions, such as at very low to very high temperatures, under water, and in space.

In summary, the main object of the present invention is to provide a thermite composition which is stable at relatively low and high temperatures and produces high-pressure and high-velocity gases.

The above and other objects and advantages and novel features of the present invention will become apparent from the following detailed description of the preferred embodiment of the invention.

DETAILED DESCRIPTION OF THE INVENTION

The thermite composition of the invention includes an oxidizable metal, an oxidizing reagent, and a high-temperature-stable gas-producing additive selected from the group consisting of metal carbides and metal nitrides. The additives include the covalent carbides, such as silicon carbide and boron carbide, but may also include interstitial carbides, such as titanium carbide and vanadium carbide. In addition, nitrides of silicon and titanium may also be used in the composition of the present invention.

The oxidizable metal is selected from the group consisting of AlSi, AlMg, Mg and aluminum, and is provided in the range from about 7.5% to about 35.5% by weight of the composition.

The oxidizing reagent is selected from the group consisting of CuO, $Cu_2O$, $Cr_2O_3$, $WO_3$, $Fe_2O_3$, $Fe_3O_4$, $MnO_2$ and $PbO_2$, and is provided in the range from about 64.0% to about 92.0% by weight of the composition.

The high-temperature-stable additive that can be added to the composition in small quantities to enhance gas production is one of the group consisting of SiC, TiC, $B_4C$ and VC. Silicon nitride or titanium nitride can also be used as a high-temperature-stable material for enhancing the gas production in the composition. The high-temperature-stable gas-producing additive is provided in the range from about 0.5% to about 10% by weight of the composition.

The oxidizable metal used in the composition provides readily oxidizable fuel. The carbon component of the additive, when oxidized, yields the gaseous products, i.e., carbon monoxide and carbon dioxide, which contribute to the production of high-temperature gas.

While the thermite mixture, that is stoichiometric with respect to the formulated redox reaction, is expected to be near thermal optimum, a range of compositions can be employed to achieve different results. A preferable thermite composition of the present invention includes 79.5% CuO, 17.5% Al and 3% SiC. The fuel-oxidizer reagent ratio for a useful blend may vary from the preferable composition by 15% or more. For example, the preferred composition may be changed to a mixture that includes 77% CuO, 20% Al and 3% SiC.

A preferred thermite composition in accordance with the present invention may be made by simply mixing the ingredients provided in the preferred ranges by weight of the total composition.

It should be noted that the thermite composition of the present invention is stable at relatively low and high temperatures and, by using the above-noted broad ranges of the ingredients, various mixtures can be prepared that are stable to 500° C. or more. Typically, the above-mentioned preferred composition is hot-pressed at 450° C.

The composition made in accordance with the present invention is versatile in that by varying various parameters, such as blend ratios, particle size, density, and solidification techniques, a high-pressure and high-velocity gas-producing composition can be tailored to give almost any combination of burn rate and pressure rise. The various compositions made in accordance with the present invention can therefore behave, on one extreme, like a relatively benign heat source and, on the other extreme, almost like an explosive.

While this invention has been described as having a preferred design, it is understood that it is capable of further modifications, uses and/or adaptations of the invention and following in general the principle of the invention and includes such departures from the present disclosure as come within known or customary practice in the art to which the present invention pertains, and as may be applied to the central features hereinbefore set forth, and fall within the scope of the invention or the limits of the claims appended hereto.

What is claimed is:

1. A high- and low-temperature-stable thermite composition for producing high-pressure, high-velocity gases, consisting essentially of (a) an oxidizable metal;

(b) an oxidizing reagent;

(c) a high-temperature-stable gas-producing additive selected from the group consisting of metal carbides and metal nitrides.

2. The composition of claim 1, wherein:

(a) said oxidizable metal is selected from the group consisting of AlSi, AlMg, Mg and aluminum.

3. The composition of claim 1, wherein:

(a) said oxidizable metal is provided in the range of from about 7.5% to about 35.5% by weight of the composition.

4. The composition of claim 1, wherein:

(a) said oxidizing reagent is selected from the group consisting of CuO, $Cu_2O$, $Cr_2O_3$, $WO_3$, $Fe_2O_3$, $Fe_3O_4$, $MnO_2$, and $PbO_2$.

5. The composition of claim 1, wherein:

(a) said oxidizing reagent is provided in the range of from about 64.0% to about 92.0% by weight of the composition.

6. The composition of claim 1, wherein:

(a) said metal carbide group is comprised of SiC, TiC, $B_4C$ and VC.

7. The composition of claim 1, wherein:

(a) said metal nitride group is comprised of SiN and TiN.

8. The composition of claim 1, wherein:

(a) said gas-producing additive is provided in the range of from about 0.5% to about 10% by weight of the composition.

9. The composition of claim 1, wherein:

(a) the composition is thermally stable to a temperature of about 500° C.

10. A high- and low-temperature-stable thermite composition for producing high-pressure, high-velocity gases, comprising:

(a) an oxidizable metal in the range of from about 7.5% to about 35.5% by weight of the composition;

(b) an oxidizing reagent in the range of from about 64.0% to about 92.0% by weight of the composition;

(c) a high-temperature-stable gas-producing additive in the range of from about 0.5% to about 10.0% by weight of composition and selected from the group consisting of metal carbides and metal nitrides.

11. The composition of claim 10, wherein:

(a) said oxidizable metal is selected from the group consisting of AlSi, AlMg, Mg and Al.

12. The composition of claim 10, wherein:

(a) said oxidizing reagent is selected from the group consisting of CuO, $Cu_2O$, $Cr_2O_3$, $WO_3$, $Fe_2O_3$, $Fe_3O_4$, $MnO_2$, and $PbO_2$.

13. The composition of claim 10, wherein:

(a) said metal carbide group is comprised of SiC, TiC, $B_4C$ and VC.

14. The composition of claim 10, wherein:

(a) said metal nitride group is comprised of SiN and TiN.

15. The composition of claim 10, wherein:

(a) said oxidizable metal is Al and comprises about 17.5% by weight of the composition;

(b) said oxidizing reagent is CuO and comprises about 79.5% by weight of the composition; and (c) said gas-producing additive is SiC and comprises about 3.0% by weight of the composition.

16. The composition of claim 10, wherein:

(a) said oxidizable metal is Al and comprises about 20% by weight of the composition;

(b) said oxidizing reagent is CuO and comprises about 77% by weight of the composition; and (c) said gas-producing additive is SiC and comprises about 3.0% by weight of the composition.

* * * * *